United States Patent [19]

Lerner

[11] Patent Number: 4,788,733

[45] Date of Patent: Dec. 6, 1988

[54] COMBINED CLEANING GLOVE AND DISPOSAL BAG

[76] Inventor: Ross E. Lerner, 13536 Christian Barrett Dr., Moorpark, Calif. 93021

[21] Appl. No.: 167,689

[22] Filed: Mar. 14, 1988

[51] Int. Cl.[4] ..... A47L 13/19

[52] U.S. Cl. ..... 15/104.94; 2/159; 15/227; 294/1.3

[58] Field of Search ..... 15/227, 104.94; 2/158–160, 164, 168; 294/1.3

[56] References Cited

U.S. PATENT DOCUMENTS

| | | | |
|---|---|---|---|
| 3,813,121 | 5/1974 | Marvin | 294/1.3 |
| 4,065,826 | 1/1978 | Hough | 15/227 |
| 4,347,931 | 9/1982 | Ginger | 15/227 |
| 4,507,803 | 4/1985 | Ryan et al. | 2/158 |
| 4,645,251 | 2/1987 | Jacobs | 15/227 X |
| 4,677,697 | 7/1987 | Hayes | 294/1.3 |

FOREIGN PATENT DOCUMENTS

| | | | |
|---|---|---|---|
| 2333482 | 7/1977 | France | 15/227 |

*Primary Examiner*—Edward L. Roberts
*Attorney, Agent, or Firm*—Jack C. Munro

[57] ABSTRACT

A glove which is to be constructed of a thin plastic material with the front surface of the glove to be substantially covered with a towel layer. The towel layer may be impregnated with a cleaning solution. Mounted on the glove in the area of the access opening to within the glove is a tie. The glove is capable of being turned inside-out to enclose a soiled article and the tie utilized to tightly shut the access opening so that the glove can now function as a disposal bag for the solid article.

2 Claims, 1 Drawing Sheet

COMBINED CLEANING GLOVE AND DISPOSAL BAG

BACKGROUND OF THE INVENTION

The field of this invention relates to cleaning devices and more particularly to a glove which is specifically designed to facilitate cleaning of a soiled area wherein also the glove can then be transformed into a bag to facilitate disposal of a soiled article.

The changing of diapers is known to be an undesirable and messy task. The normal type of diaper that is in widespread use at the present time is disposable. The typical procedure when changing a diaper is to disconnect the soiled diaper from the baby and clean the baby's buttocks area with paper towels or some type of a fabric cloth. With this conventional changing of a diaper procedure it is practically impossible for the one changing of the diaper to not to have their hands become soiled.

Although the structure of the present invention is designed to be usable in conjunction with changing of a baby's diaper, it is considered to be within the scope of this invention that the device could be usable in conjunction with any procedure which involves cleaning of a soiled surface and discarding of a soiled article.

SUMMARY OF THE INVENTION

The primary objective of the present invention is to utilize a glove which is manufactured in a manner to facilitate cleaning of the buttocks area of a baby when changing of the baby's diaper and then also to facilitate disposal of that soiled diaper avoiding the necessity of the hands of the one changing the diaper contacting the soiled area.

Another objective of this invention is to provide a hand covering which, for all practical purposes, eliminates the transfer of any bacteria from the user to the baby during changing of the baby's diaper.

Another objective of this invention is to provide a cleaning glove which can be manufactured inexpensively and therefore sold to the consumer at an inexpensive price.

Another objective of this invention is to encourage the user to clean thoroughly the buttocks area of a baby to diminish the creation of an unsanitary condition on the skin of the baby which could cause diaper rash or other skin conditions.

The structure of the present invention constitutes a thin plastic glove, although it is deemed to be feasible that the glove could be constructed of another material such as rubber. Mounted on the front surface of the glove which covers in part the palm area of the hand is attached a towel layer. This towel layer may or may not be impregnated with a cleaning solution. When using of the glove, the towel area is to be used to facilitate cleaning of the crotch area of the baby. The soiled diaper is to then be grasped by the glove. The back end of the glove is flared outwardly with this flaring to facilitate turning of the glove to an inside-out position causing the glove to now assume a bag. Mounted in conjunction with the glove is a tie. The tie can be tightened completely closing the access opening thereby completely enclosing the soiled diaper. The entire bag is now discarded within an appropriate disposal container such as a trash can.

DETAILED DESCRIPTION OF THE SHOWN EMBODIMENT

Figure 1:
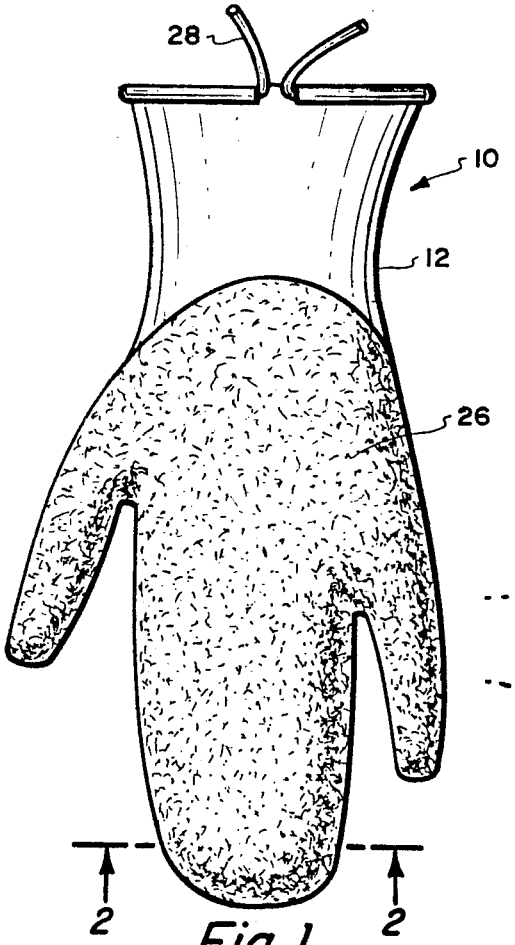
FIG. 1 is a front elevational view of the glove constructed in accordance with the present invention.

Referring particularly to the drawing there is shown in FIG. 1 the glove 10 which is composed primarily of a thin sheet plastic body 12. The back end of this body 12 defines an access opening 14. The portion of the body 12 in the area of the access opening 14 is flared outwardly as is clearly apparent within FIG. 1 of the drawing. This access opening 14 is the only opening into the interior compartment defined by the body 12. It is through this access opening 14 that the hand 16 of the user is to be inserted.

The fingers and thumb of the hand 16 are to be located within compartments defined by wall sections 18, 20 and 22. Wall section 18 is designed primarily to accommodate the thumb of the hand 16 with wall section 22 designed primarily to accommodate the little finger of the hand 16. The enlarged wall section 20 is designed primarily to accommodate the three remaining fingers of the hand 16. It has been found that the wall sections 18 and 22 provide stability during usage of the glove 10 in facilitating the cleaning operation with the primary cleaning operation occurring by the enlarged wall section 20. It is to be understood that each of the wall sections 18, 20 and 22 have an internal compartment with only the internal compartment 24 of the enlarged wall section 20 being shown.

Fixedly attached (as by adhesive) to the front surface of the body 12 is a towel layer 26. This towel layer 26 will normally be constructed either of a paper composition or a fabric composition or a combination of both. Towel layer 26 may be impregnated with a liquid cleaning substance although it is possible that a dry powdered cleaning substance could be utilized. Also, there may be utilized a glove 10 wherein the layer 26 is impregnated with a powder such as baby powder wherein that particular glove 10 would not be used for cleaning but would only be used for powdering of the baby's buttocks' area.

Fixedly mounted within the body of the glove 12 directly adjacent and surrounding the access opening 14 is a string 28. This string 28 is to function as a tie. When the hand 16 is located within the body 12 of the glove 10, the string 28 is in an untied configuration as clearly shown in FIG. 1 of the drawing.

Figure 4:
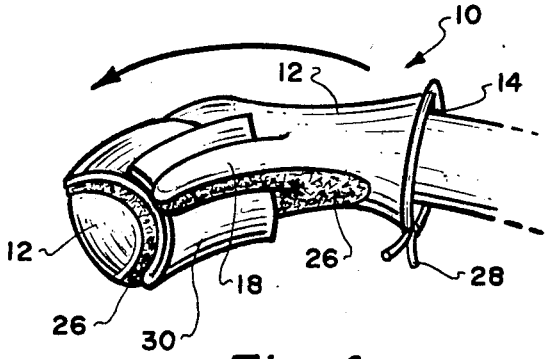
FIG. 4 is a view similar to FIG. 3 but showing the soiled diaper being grasped.
Figure 5:
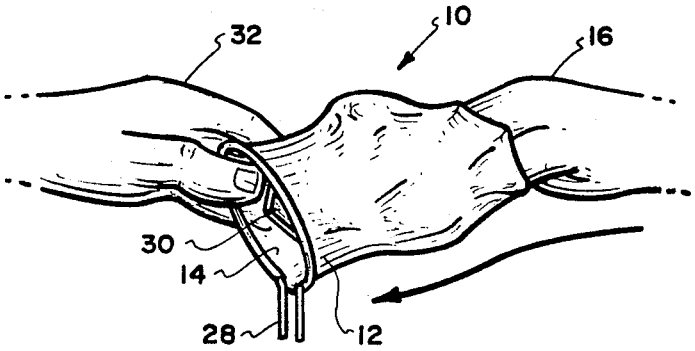
FIG. 5 is a view showing the glove assuming the inside-out position thereby encasing the soiled diaper.
Figure 2:
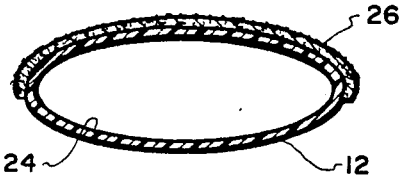
FIG. 2 is a cross-sectional view taken along line 2—2 of FIG. 1.
Figure 3:
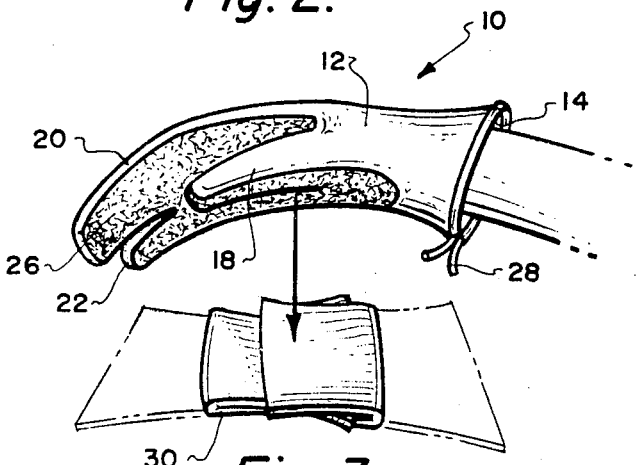
FIG. 3 shows the glove of the present invention with the user's hand located within the glove and the glove in the position to facilitate grasping of a soiled diaper.
Figure 6:
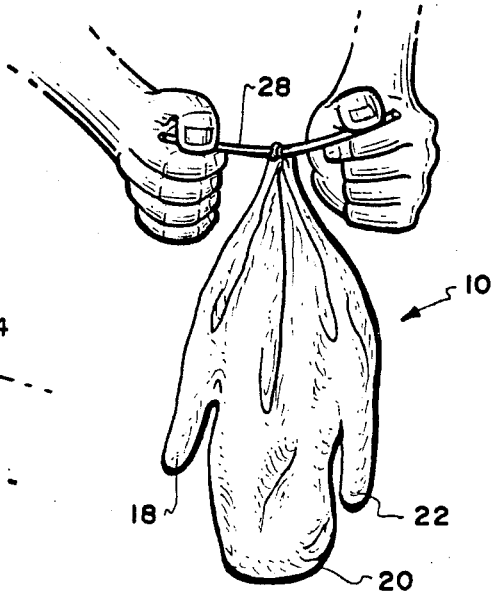
FIG. 6 is a view showing the tie being utilized to shut the access opening of the glove thereby utilizing the glove now as a disposal bag.

The operation of the glove 10 of this invention is as follows: The hand 16 is located within the body 12 of the glove 10. The towel layer 26 is then used to achieve the appropriate cleaning that is desired. Let it be assumed that there remains a soiled article such as a diaper 30. The user uses the glove 10 to grasp the diaper 30 and partially enclose such as is clearly shown in FIG. 4 of the drawing. The user then takes his/her remaining hand 32 and moves the flared end of the body 12 in the area of the tie 28 in an outward position turning the body 12 inside-out as is clearly shown in FIG. 5 of the drawing. Further movement from that in FIG. 5 results in complete disassociation of the body 12 from the hand 16 causing the body 12 to now function as a bag enclosing the soiled diaper 30. The user can then knot the tie 28 and tighten such closing of the access opening 14. This position is clearly shown in FIG. 6 of the drawing. At this particular time, the resultingly formed bag, as is shown in FIG. 6, can be discarded in an appropriate disposing container (not shown).

What is claimed is:

1. A combined cleaning glove and disposal bag for cleaning and disposing of waste comprising:

a single thin plastic glove adapted to be located about a hand of a human being, said glove having a frontal surface to be juxtapositioned against the palm area of the hand, said glove including an access opening through which the hand is to be inserted when putting on said glove;

a towel layer attached to said glove substantially covering said frontal surface, said tower layer to be usable to clean an object, whereby said glove is to be movable to an inside-out position to thereby enclose a soiled article grasped by the user;

tie means permanently incorporated with said glove directly adjacent said access opening, said tie means to be usable to tightly shut said access opening when used as said disposable bag;

said glove assuming an outwardly flared configuration in the area of said access opening, whereby said outwardly flared configuration facilitating moving said glove to said inside-out position to assume said disposal bag configuration; and said glove defining three different compartments, one of said compartments to connect with the thumb of the hand of the user and another of the compartments to connect with the little finger of the hand of the user with the remaining compartment to accommodate the other three fingers of the hand of the user, whereby said three different compartments greatly enhance the stability of said glove during usage.

2. The combined cleaning glove and disposal bag as defined in claim 1 wherein:

said towel layer being impregnated with a cleaning solution.

* * * * *